United States Patent [19]

Disanto et al.

[11] Patent Number: 5,066,946

[45] Date of Patent: Nov. 19, 1991

[54] ELECTROPHORETIC DISPLAY PANEL WITH SELECTIVE LINE ERASURE

[75] Inventors: Frank J. Disanto, North Hills; Denis A. Krusos, Lloyd Harbor, both of N.Y.

[73] Assignee: Copytele, Inc., Huntington Station, N.Y.

[21] Appl. No.: 375,056

[22] Filed: Jul. 3, 1989

[51] Int. Cl.[5] ..... G09G 3/34

[52] U.S. Cl. ..... 340/787; 340/788; 359/296

[58] Field of Search ..... 340/787, 788; 350/362

[56] References Cited

U.S. PATENT DOCUMENTS

| | | | |
|---|---|---|---|
| 3,612,758 | 10/1971 | Evans | 340/787 |
| 4,522,472 | 6/1985 | Liebert et al. | 350/362 |
| 4,742,345 | 5/1988 | Disanto et al. | 340/787 |

*Primary Examiner*—Alvin E. Oberley

*Assistant Examiner*—Doon Yue Chow

*Attorney, Agent, or Firm*—Arthur L. Plevy

[57] ABSTRACT

An electrophoretic display apparatus has grid and cathode conductors arranged as an X-Y matrix spaced from an anode with an electrophoretic dispersion in between them. Pigment particles in the dispersion become charged at selected intersection areas of the X-Y matrix and migrate towards the anode to form a display image thereon by biasing the cathode negatively with respect to the anode, and the display image is erased by oppositely biasing the cathode and anode. The anode is formed with a multiplicity of parallel anode line segments corresponding to image lines of the display, and control circuitry is provided for individually controlling the potential applied to each anode line segment in order to allow selective erasure of one or more lines and rewriting of only those lines. A new image frame having a substantial portion thereof the same as a previous frame can thus be rewritten in a shorter time.

15 Claims, 6 Drawing Sheets

TOP DOUT
BOTTOM DOUT TE
DIN CLK LE DOUT
HV 1616P
SN1
SWB
10K DIP
ANODE 62k
ANODE 62q
ANODE 62p
ANODE 62i
ANODE 62h
ANODE 62a
20
22
24
26
28
30
32
34
36
38
40
42
44
46
48
50
52
54
VDD
4.7K
DIN TOP
CLK
LE
+HV
-HV
10V LEVER
TO VPP
TO VNN
DIN BOTTOM

ELECTROPHORETIC DISPLAY PANEL WITH SELECTIVE LINE ERASURE

FIELD OF INVENTION

This invention relates to electro-optical display devices in general, and more particularly, to a display panel employing the electrophoretic effect for producing a display image.

BACKGROUND OF INVENTION

The electrophoretic effect is well known and many display devices have been designed using the electrophoretic effect to produce graphic images. One type of conventional electrophoretic display panel is shown in U.S. Pat. Nos. 4,655,897 and 4,742,345, which are commonly owned by the assignee of the present application. The electrophoretic display panel has grid and cathode conductors spaced from an anode conductor with an electrophoretic dispersion in between them. Particles of a dieletric pigment material having a light color are uniformly dispersed in a dark-colored non-conductive suspension medium. The particles in different pixel areas of the display can be made to migrate towards the anode by selectively biasing the cathode negatively with respect to the anode. The migration of the particles from the cathode to the anode, or vice versa, is used to form an image by a change in contrast of the light-colored particles against a dark-colored background of the medium.

An electrophoretic display of the above-described type has many advantages in that the materials used are relatively inexpensive, while the image formed can be maintained even when the power is removed. In order to erase the image, the cathode is biased positively with respect to the anode, i.e. to create an electric field of the opposite polarity.

In the prior art electrophoretic display devices, the anode is a unitary planar structure to which one voltage is applied in the write mode and a different voltage is applied in the erase mode. All lines of the displayed image are erased simultaneously upon application of the erase voltage to the anode, and all lines of the display must be rewritten to form the next image frame. The next frame may often have character lines or image portions which are the same as the previous frame. Because all lines are rewritten each time a new frame is displayed, the process of displaying a new frame is slowed accordingly.

It is therefore an object of the invention to provide an electrophoretic display which overcomes the aforementioned disadvantage of conventional devices. In particular, the object of the invention is to provide an electrophoretic display in which one or more lines of the display can be selectively erased and rewritten without disturbing the other image lines which remain the same from one frame to the next. It is a further object to provide a simple and inexpensive circuitry for enabling such selective line erasure in an electrophoretic display.

SUMMARY OF INVENTION

In accordance with the invention, an electrophoretic display apparatus comprises a panel having a display surface and containing an electrophoretic dispersion of particles in a suspension medium, writing means for forming an image on the display surface in a write mode by attracting charged particles from the dispersion onto the display surface in a plurality of image lines, and line erasing means for selectively erasing an image line in a line erase mode by repelling charged particles from only a portion of the display surface corresponding to the image line to be erased.

In the preferred form of the invention, the display surface is the cathode of the electrophoretic display, and the line erasing means comprises a multiplicity of anode line segments and line control means for individually controlling the potential applied to each anode line segment. For primarily a text display, each anode line segment is a longitudinal rectangular conductor having a height corresponding to the height of a text character line. The line control means comprises a corresponding multiplicity ,of switch elements for switching the potential applied to an anode line segment to be erased from a first potential for writing to a second, different potential for erasing the line segment, while all other line segments that are not to be erased are maintained at the first potential.

BRIEF DESCRIPTION OF DRAWINGS

The preferred embodiment of the invention will be described in detail below with reference to the drawings, wherein.

DETAILED DESCRIPTION OF THE PREFERRED EMBODIMENT

Figure 1:
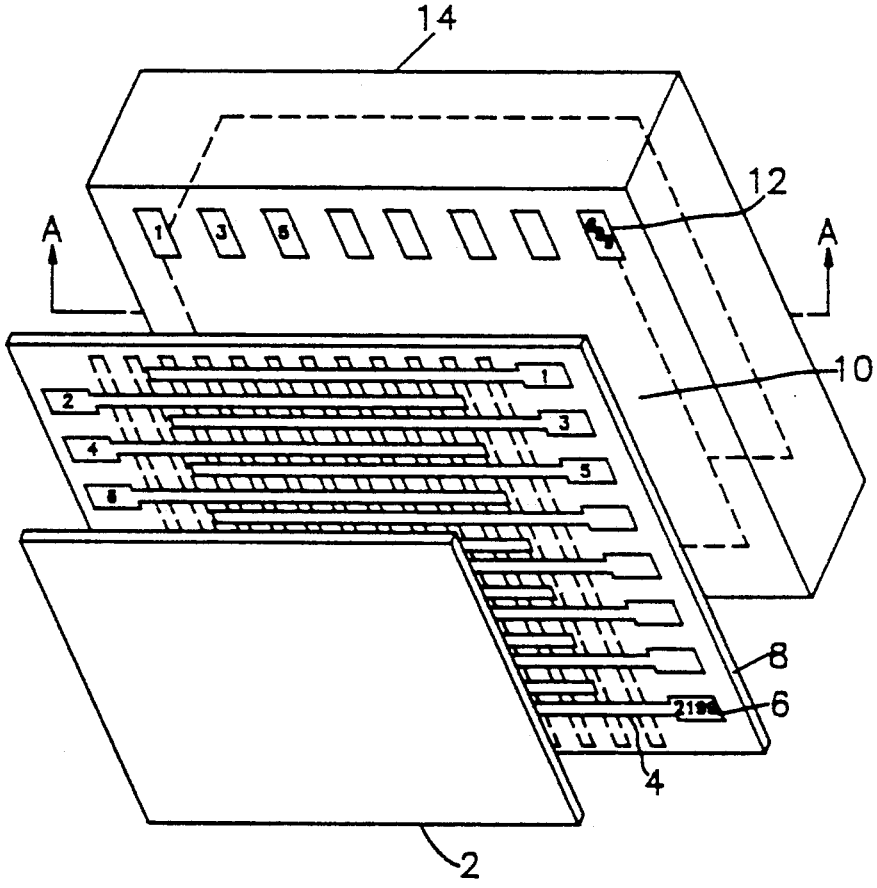
FIG. 1 is an exploded view of the structure of a conventional electrophoretic display panel in which the present invention is utilized.
Figure 2:
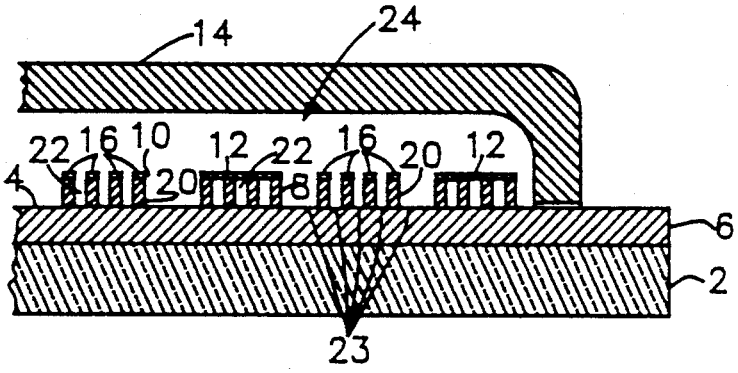
FIG. 2 PRIOR ART
FIG. 2 is a schematic sectional view of the grid, cathode, and anode of the conventional panel shown in FIG. 1 taken along view lines A—A.

Referring to FIG. 1, one type of conventional electrophoretic display apparatus, in which the present invention can be utilized, comprises a glass plate 2, a plurality of cathode row conductors 4 having contact pads 6, a photoresist layer 8, a plurality of grid column conductors 10 having contact pads 12 and another glass plate on which the anode 14 is formed. The exploded view of the display apparatus in FIG. 1 is shown substantially out of scale for purposes of illustrating the conventional grid, cathode, and anode arrangement and explaining the application of the invention. FIG. 2 shows a cross-sectional view of this arrangement taken along view lines A—A in FIG. 1, and employs common reference numerals for the common elements shown therein.

The glass plate 2 is coated with an extremely thin layer of indium-tin-oxide (ITO), e.g. approximately 300 angstroms in thickness, so that the glass plate 2 remains transparent. The plurality of row conductors 4 and associated contact pads 6, while shown as residing on one side of the photoresist layer 8, are actually etched from the ITO layer coated on the glass plate 2 through conventional photoetching or engraving techniques. The row conductors 4 are arranged as horizontal lines of the cathode for the display, with each row having a given width and being spaced by a given separation from adjacent rows. For a display having a resolution of 200 lines per inch, each cathode line may have a width of the order of 112 um and a separation of 15 um.

The photoresist layer 8 is formed over the row conductors 4 while leaving the contact pads 6 exposed for forming electrical connections therewith. The photoresist material may typically take the form of phenolic resin impregnated with a photoactive material Thereafter, the photoresist layer 8 is overcoated with a thin layer of chrome from which the plurality of column conductors 10 and associated contact pads are formed through conventional etching techniques. The column conductors are arranged as vertical lines for a grid of the electrophoretic display. The column conductors are each formed with a plurality of parallel tines which establish wells for the electrophoretic particles and obtain the desired color and contrast properties of the display. Typically, each column conductor may have 4 tine elements each of which has a width of 10–15 um and a spacing therebetween of 20 um. Once the chrome layer of column conductors with tines has been formed, the base layer of photoresist 8 is removed in all areas between the tines not having chrome thereon to form wells 22 between the tines, as best shown in FIG. 2.

In the conventional apparatus of FIG. 1, a unitary planar anode 14 may be formed by an ITO layer on a glass plate. The anode wall is sealed to the front glass plate 2 to form a fluid-tight enclosure 24 by which an electrophoretic dispersion of charged electrophoretic particles in a suspension fluid is contained. The grid and cathode lines are insulatively separated by the photoresist layer 8 by a spacing of the order of about 6 microns. The anode is spaced from the cathode-grid wafer by a distance of about 200 to 300 microns. These dimensions are exemplary only and are given to indicate the relative size and thinness of these structures. Each well 22 for retaining the particles is effectively formed near the surface of each row conductor 4 intermediate each tine of photoresist 20 underlying a conductor tine. The display area is generally rectangular and may have a total surface area equivalent to a standard 25 lines of text characters or a full page size of 8.5 by 11 inches. For a more detailed description of this type of electrophoretic display, reference is made to U.S. Pat. No. 4,742,345, which is incorporated herein. Other types of electrophoretic display structures may of course be used, for example, those having apertured conductor lines for forming the particle wells, as disclosed in U.S. Pat. No. 4,655,897.

The conventional electrophoretic display described herein is a triode device employing discrete cathode, grid, and anode structures which enable charged electrophoretic particles to migrate to and from the wells formed between the cathode and grid structures from and towards the anode structure. The cathode and grid lines form an X-Y. matrix which is used to selectively impress a field on the particles in the desired pixel areas of the display. In order to impress a field at a pixel of the X-Y matrix, operating potentials are selectively applied at the intersection point between the corresponding cathode and grid lines, thereby impressing a field on the particles retained in the well at that location.

If the cathode-grid structure is negatively biased relative to the anode and the particles are negatively charged, then application of operating potentials to the X-Y intersection will cause particles at that location to migrate to the anode, thereby creating an image by the light color of the particles at the anode against the dark color of the suspension medium, or by the absence of particles at the cathode. The particles may have a white or yellow color, while the suspension medium may have a dark grey color. While it is assumed herein that the cathode lines are arranged in the horizontal direction and the grid lines in the vertical direction, the arrangement may of course be reversed. Those skilled in the art will recognize that a display image may be viewed at either the glass associated with the cathode or that of the anode.

Figure 3:
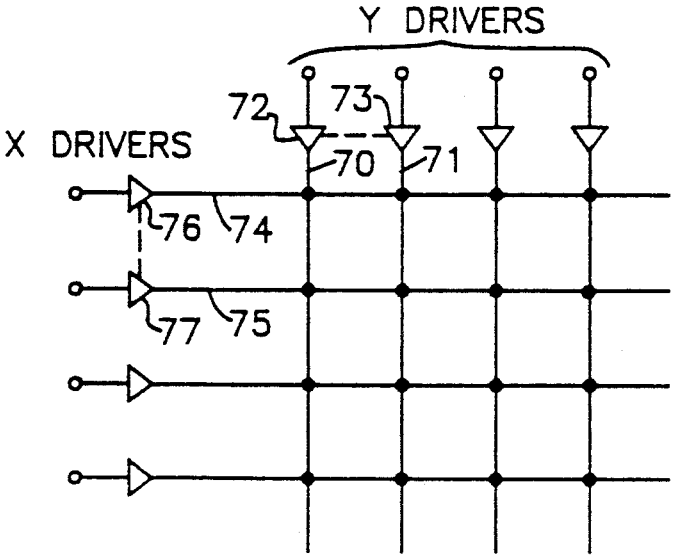
FIG. 3 PRIOR ART
FIG. 3 is a schematic diagram of the X-Y matrix control of the conventional electrophoretic display panel.

Referring to FIG. 3, a typical circuit configuration is illustrated for applying operating potentials to the X-Y matrix The Y-drivers include amplifier elements 72, 73 for applying voltages to the Y-lines 70, 71 which are the grid lines in the above-described display structure. The X-drivers include amplifier elements 76, 77 for applying voltages to the X-lines 74, 75 which are the cathode lines. The driver amplifiers may be fabricated by conventional integrated circuit techniques. Applying the proper negative biasing potentials via the respective amplifiers while holding the anode at a more positive "write" potential causes negatively charged particles to migrate toward the anode. Conversely, applying a more negative "erase" potential to the anode causes the particles to migrate back toward the wells of the cathode-grid structure.

A typical electrophoretic dispersion consists of submicron particles of a suitable pigment suspended in a fluid vehicle. The particles are encapsulated by means of a charge control and wetting agent which essentially coats the particles to enable them to retain an electrical charge. The suspension fluid wets the particles and allows them to be suspended indefinitely in the vehicle. The vehicle consists basically of a surfactant which contains no water which would interfere with the electrical operation of the panel. A typical electrophoretic dispersion may include a yellow pigment such as AAOT yellow, manufactured by Sun Chemical Company, for the particles. A suitable vehicle employed with the pigment is sold under the trademark CENTROLEX P, a charge control and wetting agent which contains lecithin To this may be added tetrachloroethylene, which is a vehicle solvent, plus a small amount of an aromatic hydrocarbon as a wetting agent. A typical particle composition contains 4% AAOT yellow, 0.16% CENTROLEX P, 80.51% tetrachloroethylene, and 15.3% of a hydrocarbon such as Aromatic 150 distributed by Exxon Corporation. The yellow pigment particles appear in high contrast to the dark grey color of the dispersion to provide a very efficient display with high visibility.

For an electrophoretic display having the above-described dispersion, a voltage of about 1 to 1.2 volts per micron of cathode-to-grid spacing is required. Suitable displays have been operated in the write mode by applying approximately +250 volts to the anode, zero watts to the grid, and zero volts to the cathode. In order to erase the display, the potentials are reversed to make the cathode positive with respect to the anode. A write or erase current of about 85 microamperes can be used, thus consuming very little power. Once an image is formed on the cathode, it will remain there even after removal of power. It is of course understood that other dispersions having different pigments may be used, such as a white pigment made of titanium oxide distributed by Dupont Company under the trademark R-101. A typical white pigment dispersion may consist of 10% R-101, 0.25% CENTROLEX P, 8% copper oleate of 4% concentration, and 81.75% tetrachloroethylene.

Figure 4:
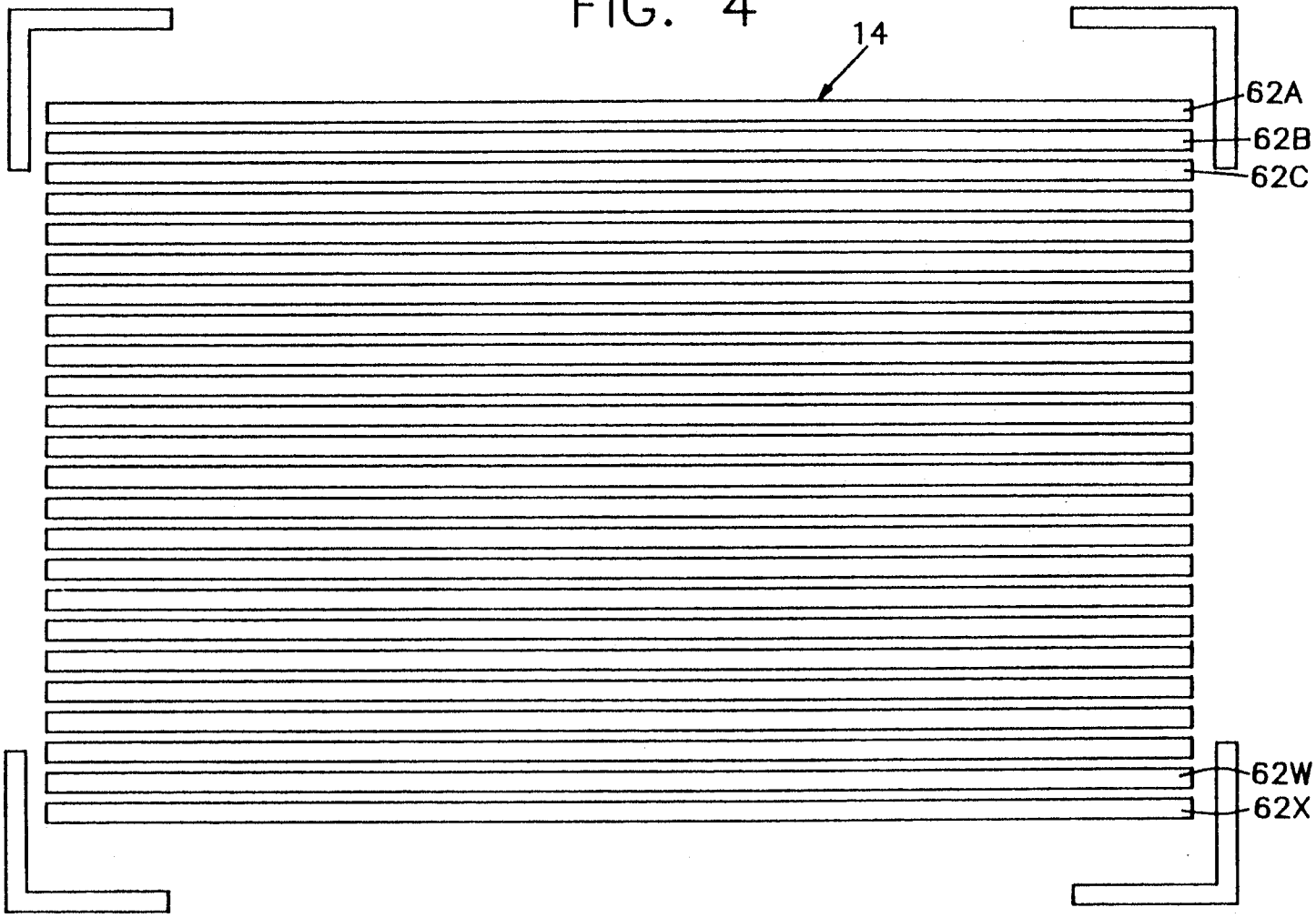
FIG. 4 is a front view of a segmented anode of an embodiment in accordance with the invention showing a multiplicity of anode line segments.

The present invention is particularly directed to an improved anode structure for an electrophoretic display which allows erasing of a selected line without erasing the entire display, thereby allowing a new frame having substantial portions the same as the previous frame to be written in less time. Referring to FIG. 4, an anode 14 comprises a multiplicity of individual anode conductor segments 62 which are separated by a small spacing from each other. In accordance with the preferred embodiment of a display for primarily 24 lines of text characters at a time, there are 24 conductor segments **62*a* through 62*x*** in the form of elongated rectangular strips in parallel and electrically insulated from each other. The height of each conductor segment corresponds to the height of a character line of the display.

As each anode segment is insulated from each other, one or more anode segments can be switched to an erase potential while the other anode segments are maintained at the write or hold potential. The result is that one or more character lines of the displayed image can be erased while the other character lines are not affected. Accordingly, only the erased line or lines need to be rewritten to complete the next frame of the display. After the line is erased, the segment is returned to the hold potential and the erased line is rewritten.

Figure 5:
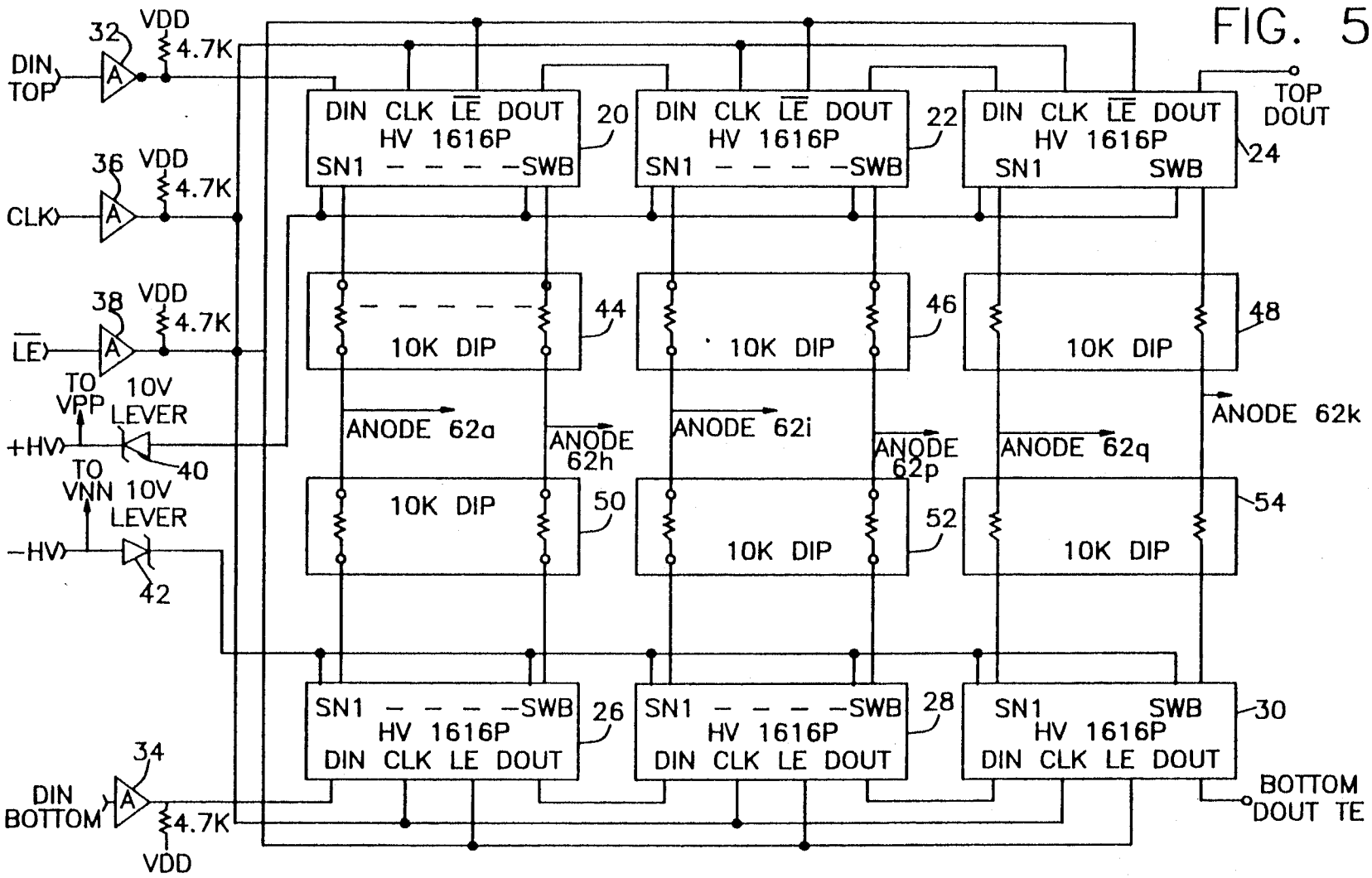
FIG. 5 is an electrical circuit diagram of a preferred switching circuitry for individually controlling the anode line segments.

The selective switching of one or more anode segments to the erase potential is accomplished by the anode switching circuit depicted in FIG. 5. Three 8-channel high voltage switch units 20, 22 and 24 are connected in series to a data input DIN TOP by way of an amplifier 32. Similarly, another three 8-channel high voltage switch units 26, 28 and 30 are connected in series to a data input DIN BOTTOM by way of an amplifier 34.

In the preferred embodiment, each high-voltage switch unit is an HV1616P chip made by Supertex Inc. Each HV1616P chip has an 8-bit shift register coupled to an input terminal DIN and output terminal DOUT and an 8-bit latch in response to a latch enable signal received on input terminal LE. The input terminal DIN of the switch 20 is coupled to the data input DIN TOP; the input terminal DIN of the switch 22 is connected to the terminal DOUT of switch 20; and the input terminal DIN of the switch 24 is connected to the terminal DOUT of switch 22.

The state of switch elements SW1 through SW8 of each of the high-voltage switch units 20, 22, and 24 is determined by the data input at DIN TOP. A train of 24 bits is shifted into the three 8-bit shift registers, and the switch elements SW1 through SW8 of each unit is set by latching the input bits into their respective latches. Depending on whether the respective input bits are high or low, the corresponding switch elements SW1–SW8 of the switch units 20, 22, and 24 are independently opened or closed. Similarly, the switch units 26, 28, and 30 are connected in series to the data input DIN BOTTOM to latch the respective bits of the 24-bit input train to their respective switch elements and independently open or close the switch elements SW1–SW8 of each of the three switch units.

Each switch element of the switch units 20, 22, and 24 couples a corresponding one of the anode segments **62*a* through 62*x* to the +HV (write or hold) voltage source by way of a 10-volt Zener diode 40 and a corresponding 10 kilo-ohm resistor of the DIP banks 44, 46, and 48. Similarly, each switch element of the switch units 26, 28, and 30 couples a corresponding one of the anode segments 62*a* through 62*x* to the −HV (erase) voltage source by way of a 10-volt Zener diode 42 and a corresponding 10 kilo-ohm resistor of the DIP banks 50, 52, and 54. For normal writing and erasing of the 24 character lines of the display, all anode line segments 62*a* through 62*x* are connected to the +HV and the −HV potentials, respectively. However, in the selective line erasing mode, a selected anode segment is connected to the −HV voltage source to be erased. That is, in the case where all 24** lines have been written and only one or more line(s) is (are) to be erased to form a new frame, only the selected anode segments are disconnected from the hold potential +HV and connected to the erase potential −HV, while the others are maintained at the hold potential. Thus, the DIN TOP signal must be the complement of the DIN BOTTOM signal. To rewrite the selected lines, the corresponding anode segments are then disconnected from the −HV erase potential and reconnected to the +HV hold potential.

The foregoing complementary signal control of the respective rows of high-voltage switch units is coordinated by a clocking signal sent from the CLK input to the CLK terminals of the six switch units by way of amplifier 36. The switch elements of all switch units are all set simultaneously by a common latch enable signal sent from the LE input to the LE terminals of each of the switch units by way of amplifier 38.

Figure 6:
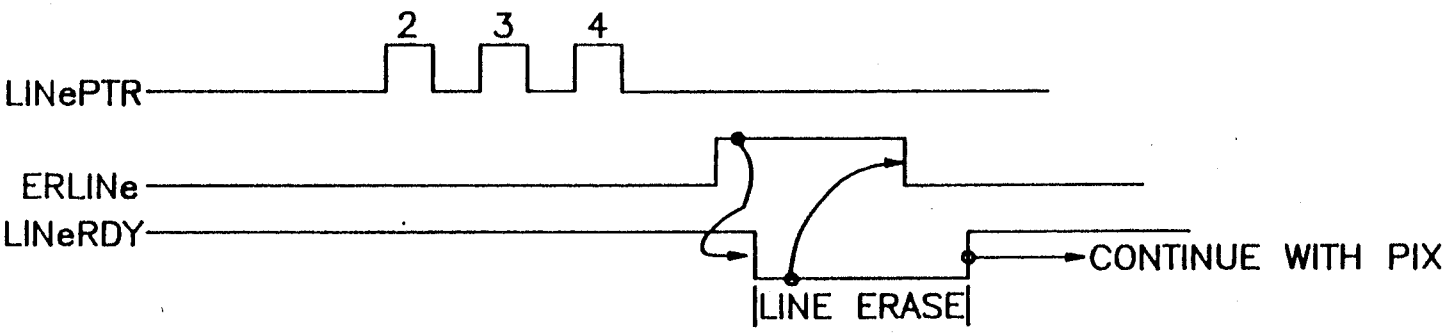
FIG. 6 is a timing diagram showing the line erase mode for the display apparatus of the invention.

The waveforms in FIG. 6 show an example of the selection of an individual line to be erased by control signals supplied from the interface to the panel switching circuitry. The signal LINEPTR points to the line to be erased. In the example, the signal LINEPTR indicates that the fourth character line is to be erased. Note that only three pulses are necessary since the signal is normally pointing to the first line. The LINEPTR signal is used to generate the complementary 24-bit DIN TOP input signal with only the bit in the fourth anode segment position low, and the DIN BOTTOM input signal with only the bit in the fourth anode segment position high. The ERLINE signal is then sent, the latch enable LE input signal is generated, and line four is erased. The LINERDY signal is sent when the line is ready to be rewritten. In this example, it is assumed that each character line is comprised of 26 scan lines. Thus, the data bank for the display sends 78 RTS signals to the panel interface (each RTS signal is answered by a CTS signal) to skip the first three character lines. Following the 79th RTS signal and upon receipt of a CTS signal, the data bank sends the desired line data to the cathode and grid lines for rewriting the fourth character line.

Figure 7A:
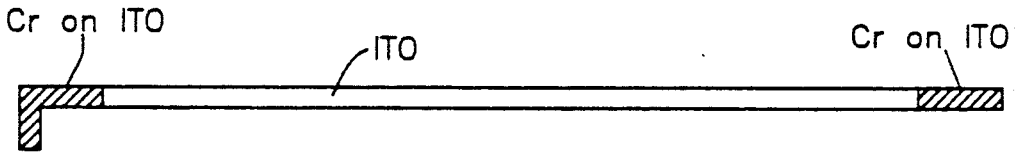
FIG. 7A and 7B are diagrammatic views of the manner in which each anode line segment is aligned with the cathode.
Figure 7B:
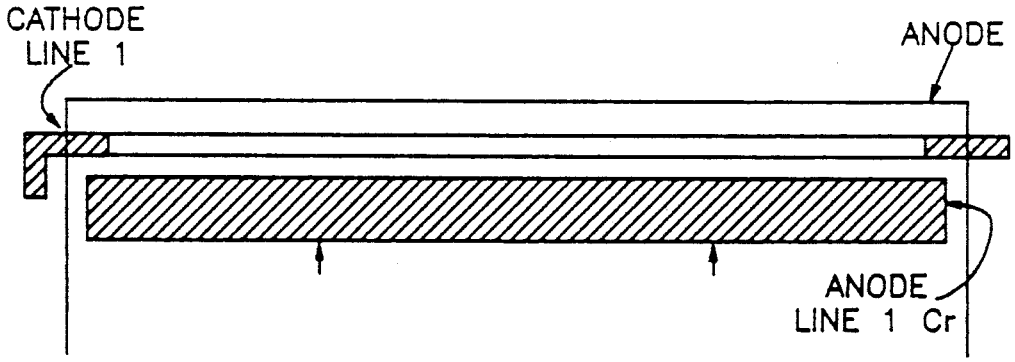

Use of the 24-segment anode of the invention requires alignment of the cathode lines and the anode segments each of which extend horizontally in parallel with respective ones of the other. The assembly procedure adopted involves laying the top of the first anode segment directly in line with the top of the first cathode line. As shown in FIG. 7A, most of the cathode line 1 has transparent indiumtin-oxide (ITO) on it, while both ends, i.e. the chip mounting end and test comb area, are covered with chrome. Due to the high reflectivity of the chrome surface, both ends of the cathode line are visible, and adjustment of the anode line 1 to its proper position over the cathode line is facilitated. The anode segment is adjusted until the chrome appears as a line continued over the top of the anode segment, as shown in FIG. 7B. Slight movement of the anode segment in the direction of the arrows is used to obtain alignment. Although there is some parallax due to a typical 14-mil spacing between the cathode and anode, this causes an error of at most only a few mils in practice. Significant twist error is unlikely since the lines are typically 7 to 8 inches from end to end.

The above-described embodiments of the invention are intended to be illustrative only, and many other variations and modifications may be made thereto in accordance with the principles of the invention. All such embodiments and variations and modifications thereof are considered to be within the scope of the invention, as defined in the following claims.

We claim:

1. An electrophoretic display apparatus comprises a display panel having a display surface and containing an electrophoretic dispersion of particles in a suspension medium, writing means for forming an image on the display surface in a write mode by attracting charged particles from the dispersion onto the display surface in a plurality of image lines, and line erasing means for selectively erasing a particular image line from among said plurality of image lines during a line erase mode, said particular image being erased by repelling charged particles from only a portion of the display surface corresponding to the image line to be erased such that a remainder of said plurality of image lines remains undisturbed during said line erase mode thereby allowing a new frame having substantial portions the same as the previous frame.

2. An electrophoretic display apparatus according to claim 1, wherein the line erasing means comprises a multiplicity of parallel anode line segments, each anode line segment being electrically insulated from adjacent anode line segments, and line control means for individually controlling each anode line segment by applying a first potential thereto for writing a corresponding image line, and a second potential thereto for erasing the image line.

3. An electrophoretic display apparatus according to claim 2, wherein the display panel is configured for display of a plurality of text character lines, and each of the anode line segments is a longitudinal rectangular conductor having a height corresponding to the height of a text character line.

4. An electrophoretic display apparatus according to claim 2, wherein charged particles from said electrophoretic dispersion are attracted to the surface of each anode line segment having said first potential applied thereto and are repelled from the surface of said anode line segment having said second potential applied thereto.

5. An electrophoretic display apparatus according to claim 2, wherein said line control means comprises a first multiplicity of switch elements each operable to couple a corresponding one of said anode line segments to a source of said first potential, and a second multiplicity of switch elements each operable to couple a corresponding one of said anode line segments to a source of said second potential, and control signal input means for inputting control signals for individually controlling the opened or closed states of said first and second multiplicities of switch elements.

6. An electrophoretic display apparatus according to claim 5, wherein each of said first and second multiplicities include an integer number N of switch elements corresponding to the number of anode line segments, and said control signal input means comprises means for opening only the n-th switch element of said first multiplicity of switch elements and opening all switch elements of said second multiplicity of switch elements except closing the n-th switch element in order to erase only the n-th anode line segment, n being an integer between 1 and N.

7. An electrophoretic display apparatus according to claim 1, wherein said writing means comprises a multiplicity of parallel cathode conductors, and a multiplicity of parallel grid conductors which are insulatively spaced from and arranged perpendicular to said cathode conductors to form an X-Y matrix, and display driver means for applying potentials selectively to said cathode conductors and said grid conductors so as to impress charges on particles in the corresponding areas of intersection of said X-Y matrix to form a display image of respective pixel elements on said display surface.

8. An electrophoretic display apparatus according to claim 7, wherein each of said grid conductors is formed with a plurality of tined conductor elements in parallel with each other to form wells therein for retaining particles in the vicinity thereof.

9. An electrophoretic display apparatus according to claim 7, wherein said cathode conductors are formed from an indium-tin-oxide layer coated on an interior side of one surface of said display panel, an insulative layer is provided over said cathode conductors, and said grid conductors are formed of a metal material on said insulative layer.

10. An electrophoretic display apparatus according to claim 7, wherein the line erasing means comprises a multiplicity of parallel anode line segments, each anode line segment being electrically insulated from adjacent anode line segments and each being aligned with a respective one of said cathode conductors, and line control means for individually controlling each anode line segment by applying a first potential to attract charged particles thereto for writing a corresponding image line, and a second potential for repelling the particles therefrom for erasing the image line.

11. An electrophoretic display apparatus according to claim 10, wherein said cathode and grid lines are biased to apply negative charges to the particles, and said first potential applied to an anode line segment creates a positive electric field in the direction of said anode line segment for writing the corresponding image line, and said second potential applied to said anode line segment creates a negative electric field in the direction away from said anode line segment for erasing the image line.

12. An electrophoretic display apparatus according to claim 1, wherein said second potential is applied to all of said anode line segments in a normal erase mode for erasing all image lines of the display.

13. An electrophoretic display apparatus according to claim 1, wherein said line erasing means comprises a multiplicity of parallel anode line segments formed from an indium-tin-oxide layer coated on an interior side of a transparent display surface of said display panel, wherein the anode line segments are electrically insulated from each other and are substantially transparent when viewed through said display surface, and line control means for individually controlling each anode line segment by applying a first potential thereto for writing a corresponding image line, and a second potential thereto for erasing the image line.

14. An electrophoretic display apparatus according to claim 1, wherein said particles of said electrophoretic dispersion are made of a light-colored pigment material and said suspension medium provides a dark-colored background in contrast with said light-colored particles in order to form a display image.

15. An electrophoretic display apparatus according to claim 2, wherein said line control means can apply said first potential thereto for writing said image line at said corresponding image line previously erased while said remainder of said plurality of image lines remains undisturbed.

* * * * *